US011193510B2

(12) United States Patent
Medaglia

(10) Patent No.: US 11,193,510 B2
(45) Date of Patent: Dec. 7, 2021

(54) HYDRAULIC STAGE

(71) Applicant: Microtecnica S.r.l., Turin (IT)

(72) Inventor: Agostino Medaglia, Monza (IT)

(73) Assignee: MICROTECNICA S.R.L., Turin (IT)

( * ) Notice: Subject to any disclaimer, the term of this patent is extended or adjusted under 35 U.S.C. 154(b) by 196 days.

(21) Appl. No.: 16/435,659

(22) Filed: Jun. 10, 2019

(65) Prior Publication Data

US 2019/0389564 A1 Dec. 26, 2019

(30) Foreign Application Priority Data

Jun. 25, 2018 (EP) ..... 18179688

(51) Int. Cl.
*F15B 13/043* (2006.01)
*F15B 9/09* (2006.01)
*F15B 13/044* (2006.01)

(52) U.S. Cl.
CPC ..... *F15B 13/0438* (2013.01); *F15B 9/09* (2013.01); *F15B 13/044* (2013.01); *F15B 2211/413* (2013.01); *F15B 2211/426* (2013.01); *F15B 2211/7054* (2013.01); *F15B 2211/765* (2013.01); *Y10T 137/86598* (2015.04)

(58) Field of Classification Search
CPC ..... F15B 9/07; F15B 9/09; F15B 13/0438; F16K 31/005; F16K 31/006; Y10T 137/86598
See application file for complete search history.

(56) References Cited

U.S. PATENT DOCUMENTS 3,152,612 A * 10/1964 Avery ..... F16K 31/006 137/625.4
3,224,278 A * 12/1965 Reid ..... G05D 16/18 73/510
3,524,474 A 8/1970 McCormick
(Continued)

FOREIGN PATENT DOCUMENTS

CN 2612829 Y 4/2004
EP 2157344 A1 2/2010
(Continued)

OTHER PUBLICATIONS

Extended European Search Report for International Application No. 18179688.9 dated Dec. 21, 2018, 27 pages.

*Primary Examiner* — Robert K Arundale
*Assistant Examiner* — Richard K. Durden
(74) *Attorney, Agent, or Firm* — Cantor Colburn LLP

(57) ABSTRACT

A hydraulic stage includes a hydraulic element located between and sealing a first and second chamber, wherein the first chamber comprises at least one aperture through which fluid is arranged to flow into or out of the first chamber; and at least one piezoelectric element which is positioned adjacent to the at least one aperture and is arranged to deform in response to an applied potential difference such that it blocks or obstructs the at least one aperture to a varying degree according to the level of deformation, so as to control fluid flow into or out of the first chamber. The level of deformation of the piezoelectric element thus reduces or increases an effective size of the inlet or outlet aperture to which it is adjacent, restricting or permitting an increase in fluid flow accordingly.

13 Claims, 7 Drawing Sheets

(56) References Cited

U.S. PATENT DOCUMENTS

| | | | | | |
|---|---|---|---|---|---|
| 4,298,181 | A * | 11/1981 | Corrado | F15B 13/0431 | 137/625.64 |
| 4,510,973 | A * | 4/1985 | Balaskas | F15B 13/042 | 137/596.18 |
| 4,617,952 | A * | 10/1986 | Fujiwara | F15B 5/003 | 137/596.17 |
| 4,705,059 | A * | 11/1987 | Lecerf | F15B 13/0438 | 137/625.61 |
| 5,630,440 | A * | 5/1997 | Knutson | F02M 59/466 | 137/554 |
| 6,017,016 | A | 1/2000 | Jackson | | |
| 2001/0007265 | A1* | 7/2001 | Itzhaky | F16K 31/005 | 137/883 |
| 2004/0221896 | A1* | 11/2004 | Ballenger | F16K 37/0041 | 137/554 |
| 2017/0324021 | A1 | 11/2017 | Bertrand et al. | | |
| 2019/0195381 | A1* | 6/2019 | Jaskiewicz | F16K 31/006 | |
| 2020/0063883 | A1* | 2/2020 | Yuan | F02C 9/26 | |

FOREIGN PATENT DOCUMENTS

| | | | | |
|---|---|---|---|---|
| FR | 2573168 | A1 * | 5/1986 | F15B 13/0438 |
| FR | 2573168 | A1 | 5/1986 | |
| JP | 2001082411 | A | 3/2001 | |
| WO | 2017071753 | A1 | 5/2017 | |
| WO | 2018062608 | A1 | 4/2018 | |

* cited by examiner

HYDRAULIC STAGE

FOREIGN PRIORITY

This application claims priority to European Patent Application No. 18179688.9 filed Jun. 25, 2018, the entire contents of which is incorporated herein by reference.

TECHNICAL FIELD

The present disclosure relates to electro valves, particularly those used in hydraulic systems, and especially those used in the aeronautical industry.

BACKGROUND

Hydraulic systems are used in a wide variety of technologies to enable the application of large forces to be controlled with inputs of much lower force. In conventional hydraulic machinery (e.g. a hydraulic excavator) for example, a user operates manually the opening and closing of one or more valves which control the flow of pressurised hydraulic fluid within a hydraulic system. Through the operation of these valves, the pressurised fluid is directed to and from various actuators (e.g. pistons) where it can be used to produce very large forces (e.g. to lift large quantities of material).

Many hydraulic systems make use of electronic valves (e.g. solenoid valves), which are controlled using electrical signals sent by a user (or an automated control system) rather than by manual actuation. This allows actuators to be controlled from a long distance away without requiring lengthy and complex hydraulic networks or mechanical links (e.g. control cables) between a user and an actuator. The signals may instead be sent via electronic cables, which are typically easier and less expensive to implement, and also require little maintenance. Because electronic valves can be located near to the actuator, only a small hydraulic circuit is required, further reducing costs and weight and increasing reliability.

For example, many aircraft today employ "fly-by-wire" control systems, in which a pilot's inputs are transmitted to electronic valves of hydraulic systems via electronic signals (carried "by wire"). The signals cause certain valves to open/close depending on the pilot's desired action (e.g. adjusting flaps, extending landing gear) without any mechanical interaction of the pilot with the hydraulic system. Reducing the amount of hydraulic equipment on aircraft is desirable as it reduces weight and cost and can improve reliability.

In addition, fly-by-wire systems enable the use of semi-automatic control systems, which interpret a pilot's inputs to flight controls and issue what they determine to be the necessary electrical signals to the electronic valves themselves. Advantages of such a system are increased stability, fuel savings and a reduced possibility of operating the aircraft outside of its performance envelope.

However, electronic valves used in these systems are often expensive, bulky and vulnerable to failures. For example, such valves typically employ solenoids to move a flapper or a fluid jet in order to control fluid flows within the valve.

SUMMARY

When viewed from a first aspect, the present disclosure provides a hydraulic stage that includes a hydraulic element located between and sealing a first and second chamber, wherein the first chamber comprises at least one aperture through which fluid is arranged to flow into or out of the first chamber. The stage also includes at least one piezoelectric element which is positioned adjacent to the at least one aperture and is arranged to deform in response to an applied potential difference such that it blocks or obstructs the at least one aperture to a varying degree according to the level of deformation, so as to control fluid flow into or out of the first chamber.

The level of deformation of the piezoelectric element thus reduces or increases an effective size of the inlet or outlet aperture to which it is adjacent, restricting or permitting an increase in fluid flow accordingly. The degree to which the at least one aperture is blocked or obstructed may be varied between two values (i.e. a binary variation), although more generally the degree of obstruction may be varied between several discrete levels or even continuously (i.e. to any position within a continuous range). Generally, the piezoelectric element is arranged to restrict fluid flow into or out of the first chamber when in a neutral position (i.e. when no potential difference is applied) so that deformation away from the aperture reduces the obstructing effect and permits an increase in fluid flow into or out of the first chamber and deformation towards the aperture increases the obstructing effect and further decreases or eliminates fluid flow into or out of the first chamber.

Varying incoming or outgoing fluid flow to the first chamber by deforming the piezoelectric element causes the pressure within the first chamber to change relative to the second chamber (which remains at the same pressure). The resulting difference in pressure leads to a net force being applied to the hydraulic element causing it to move. The movement and/or position of the hydraulic element can thereby be controlled through controlling the deformation of the piezoelectric element. The deformation of the piezoelectric element can be controlled by changing the potential difference applied to the piezoelectric element. This enables a potentially bulky and heavy hydraulic element to be controlled using a small applied potential difference without requiring the use of any electronic actuators such as solenoids.

In some examples, the first chamber comprises an inlet aperture with a characteristic size, through which fluid may be introduced to the first chamber under pressure, e.g. from a fluid reservoir, a pump or a pressurized line. The hydraulic stage may be configured such that a certain amount of fluid leakage from the first chamber is expected, allowing the pressure in the first chamber to be controlled simply by controlling the level of fluid flow through the inlet aperture using the piezoelectric element.

However, in preferred examples, the first chamber may also comprise an outlet aperture, through which hydraulic fluid may exit the first chamber. In such examples a pressure inside the first chamber is dependent upon the relative effective sizes of the inlet and outlet apertures and the pressure under which fluid from the fluid reservoir is introduced. For example, assuming a fixed inlet aperture, if the effective size of the outlet aperture were reduced, the pressure inside the first chamber would increase; if the size of the outlet aperture were increased the pressure inside the first chamber would decrease, for a given input pressure.

The piezoelectric element may be positioned adjacent to the inlet aperture or the outlet aperture and is arranged to control fluid flowing therethrough.

The piezoelectric element may comprise a piezoelectric bimorph made up of a stack of two piezoelectric layers adhered together. When a potential difference is applied to the bimorph, the piezoelectric layers undergo differential expansion (e.g. one layer may expand while the other contracts), causing the bimorph to deform by bending. The magnitude and/or polarity of potential difference applied to the bimorph may affect the degree of and/or direction of deformation (e.g. degree and/or direction of bending) experienced by the piezoelectric element. In such examples at least one end of the bimorph may be fixed in place, such that a bending deformation causes the piezoelectric element to curve towards or away from the aperture. The direction of the curve may be determined by the polarity of the applied potential difference. Preferably, both ends of the bimorph are fixed in place, such that a bending deformation causes the piezoelectric element to curve into an arc between the fixed ends. The at least one piezoelectric element may comprise any suitable piezoelectric material, for example PZT (Modified lead zirconate titanate).

In examples featuring a bimorphic piezoelectric element, the element bending in a first direction (due to, say, a positive potential difference being applied) away from the inlet or outlet aperture will increase the fluid flow into or out of the first chamber. When an opposite (e.g. negative) potential difference is applied, the piezoelectric element bends in the other direction, towards the inlet or outlet aperture, decreasing the fluid flow.

In a preferred example, the at least one piezoelectric element is a piezoelectric bimorph positioned adjacent to an outlet aperture of the first chamber, which also features an inlet aperture with a fixed size. In this example, the pressure inside the first chamber may be increased or decreased by applying the requisite potential difference to the bimorph to cause it to block or unblock (or vary the degree of obstruction of) the outlet aperture and reduce or increase its effective size. As the size of the inlet aperture is fixed, this results in the desired change of pressure (and thus the desired movement of the hydraulic element).

The hydraulic fluid may be water, oil or any other hydraulic fluid known in the art. The first and second chambers may typically experience a pressure of between 5 and 300 bar (0.5 MPa and 30 MPa).

Conventional electronic hydraulic valves often operate by selectively energizing a solenoid such that it generates a magnetic field which attracts (or repels) a permanent magnet actuator. The actuator is arranged such that it can move between an open and closed position.

However, solenoids can be very complicated components comprising several moving parts and many potential points of failure as well as being bulky. The hydraulic stage of the present disclosure, however, utilises no electronic actuators (i.e. solenoids) and as a result fewer components are required. This not only reduces the cost of the hydraulic stage but also decreases the likelihood of failures. In addition, the weight and/or volume of the hydraulic stage may be reduced. It has been estimated that a hydraulic stage according to the present disclosure can achieve at least a 30% reduction in volume and/or at least a 30% reduction in weight when compared to conventional hydraulic stages. For example, a conventional servovalve typically has a mass of around 200 g and a volume of around 23500 $mm^3$, but it may be possible to manufacture a hydraulic stage according to the present disclosure with a mass of 100 g or less and/or a volume of 10000 $mm^3$ or less.

A hydraulic stage according to the present disclosure may also consume less power than a conventional hydraulic stage as the solenoids of a conventional device require a current to be maintained to maintain the magnetic field, whereas the piezoelectric element only requires a potential difference to be maintained to maintain its deformed shape.

Furthermore, because there are no permanent magnets or electromagnets utilised by the hydraulic stage of the present disclosure, the operation of the hydraulic stage is not influenced by the presence of external magnetic fields.

Preferably, the hydraulic stage further comprises a second piezoelectric element, arranged to control fluid flow into or out of the second chamber. This may enable the use of a larger hydraulic element and also adds redundancy to the hydraulic stage. For example, the first piezoelectric element may be arranged to control fluid flow out of the first chamber and the second piezoelectric element to control fluid flow out of the second chamber (with both the first and second chambers having fixed inlets). A desired pressure differential may be established between the first and second chambers (to produce a desired movement of the hydraulic element) by deforming either element. For example, to increase the pressure in the first chamber relative to the second chamber, one can either decrease fluid flow out of the first chamber using the first piezoelectric element, or one can increase fluid flow from the second chamber using the second piezoelectric element. This provides redundancy in the valve as the hydraulic element can be effectively controlled by either one of the two piezoelectric elements. Thus if one of the piezoelectric elements fails for any reason, e.g. an electrical or mechanical failure, the other piezoelectric element can still be used to fully control the hydraulic element.

Providing two piezoelectric elements can also enable a pressure differential to be established between the first and second chambers of a greater magnitude than that possible with only one piezoelectric element. In the example described above, the first piezoelectric element could deform to increase fluid flow from the first chamber, whilst the second piezoelectric element deforms to decrease fluid flow from the second chamber. This has the effect of both lowering the pressure in the first chamber and increasing the pressure in the second chamber, resulting in a larger pressure differential than that achievable with just one piezoelectric element. An increased pressure differential results in a greater net force on the hydraulic element, which can improve response times and/or enable the use of a larger hydraulic element (e.g. to control larger machinery).

The hydraulic element may comprise a piston or a spool. The hydraulic stage may be a hydraulic valve such as a spool valve or electro-hydraulic servo valve (also known as an electro-hydraulic spool valve).

In some examples the hydraulic element may be directly (i.e. mechanically) connected to a moveable component (e.g. a control surface on an aircraft), although in other examples the hydraulic element may comprise a component of a secondary hydraulic stage (i.e. it may be arranged to control the flow of hydraulic fluid in the secondary hydraulic stage).

The hydraulic stage may comprise a position feedback system. For example, an electronic position sensor may be coupled to the hydraulic element to provide information regarding the position of the actuator relative to a neutral position (e.g. equidistant between the first and second chambers). The position information may be used to adjust the potential difference applied to the piezoelectric element(s), for example to attain and/or maintain a desired position of the hydraulic element or to smooth movements of the hydraulic element (e.g. by ramping the applied potential difference according to the position of the hydraulic element relative to a target position).

Additionally or alternatively, a mechanical feedback system may be provided comprising a feedback member which is mechanically coupled to the hydraulic element, wherein the feedback member is arranged to control fluid flow into or out of the first and/or second chamber in response to movement of the hydraulic element. The feedback member may be arranged to mechanically deform the at least one piezoelectric element. The feedback member may be positioned adjacent to the at least one piezoelectric element. The feedback member may be arranged to mechanically deform the at least one piezoelectric element by moving towards and contacting the at least one piezoelectric element.

The feedback member may be mounted on a pivot about which it may rotate to move towards the at least one piezoelectric element, e.g. through the use of a non rotationally-symmetric member. Alternatively a rotationally (or non-rotationally) symmetric member may be mounted with an off-axis pivot. Alternatively, the feedback member may be arranged to translate towards the at least one piezoelectric element (e.g. by being rigidly coupled to the hydraulic element).

Piezoelectric materials generate voltage proportional to their deformation when subjected to an external force (e.g. a mechanical deformation). The inventor has appreciated that this property may be exploited to estimate the position of the hydraulic element. A generated voltage may be measured to provide an indication of the deformation of the at least one hydraulic element and therefore may be used as part of a position monitoring or position feedback system. In some examples where the feedback member is arranged to mechanically deform the at least one piezoelectric element, therefore, the position feedback system is configured to measure a potential difference generated by the at least one piezoelectric element and to use the measured potential difference to estimate a position of the hydraulic element.

The position feedback system may be configured to provide negative feedback. In some examples comprising a mechanical feedback system, for instance, a lever may be arranged such that movement of the hydraulic element causes the lever to deform at least one piezoelectric element. Thus movement of the hydraulic element into the first chamber moves the lever which in turn causes fluid flow to or from the first chamber to be altered, thereby increasing the pressure within the first chamber until it matches that in the second chamber, reaching an equilibrium in which there is no net force on the hydraulic element.

The position feedback system may be arranged to control the fluid flow such that the hydraulic element returns to a neutral position when no potential difference is applied to the piezoelectric element(s). Alternatively, the position feedback system may be arranged to control the fluid flow such that the hydraulic element remains in place when a potential difference is removed to the piezoelectric element(s).

The feedback member may comprise a cylinder with an off-axis pivot, which is coupled to the hydraulic element such that movement of the hydraulic element causes the cylinder to rotate about its off centre pivot. The cylinder may be located between first and second piezoelectric elements which are in turn positioned adjacent to outlet apertures of the first and second chambers. In such an example, the movement of the hydraulic element caused by piezoelectric deformation of, for instance, the first piezoelectric element, causes the cylinder to rotate about its off-axis pivot such that it applies a mechanical force to the second piezoelectric element, causing it to deform in a manner similar to that achieved by applying a potential difference. This has the result of opposing the pressure increase (and thus movement of the hydraulic element) caused by the piezoelectric deformation of the first piezoelectric element providing negative feedback to the hydraulic stage.

A hydraulic stage according to the present disclosure has many applications, such as flight controls on aircraft, braking systems in cars and other hydraulic systems which require electronic control.

When viewed from a second aspect, the present disclosure provides a method of operating a hydraulic stage, the hydraulic stage includes a hydraulic element located between and sealing a first and second chamber, wherein the first chamber comprises at least one aperture through which fluid is arranged to flow into or out of the first chamber; and at least one piezoelectric element which is positioned adjacent to the at least one aperture. The method comprises: controlling the fluid flow into or out of the first chamber by applying a potential difference to the at least one piezoelectric element such that it deforms so as to block or obstruct the at least one aperture to a varying degree according to the level of deformation.

It will be appreciated that all of the preferred features of the hydraulic stage described above may also apply to this second aspect of the disclosure.

BRIEF DESCRIPTION OF THE FIGURES

One or more non-limiting examples of the present disclosure will now be described with reference to the accompanying Figures, in which.

DETAILED DESCRIPTION

Figure 1:
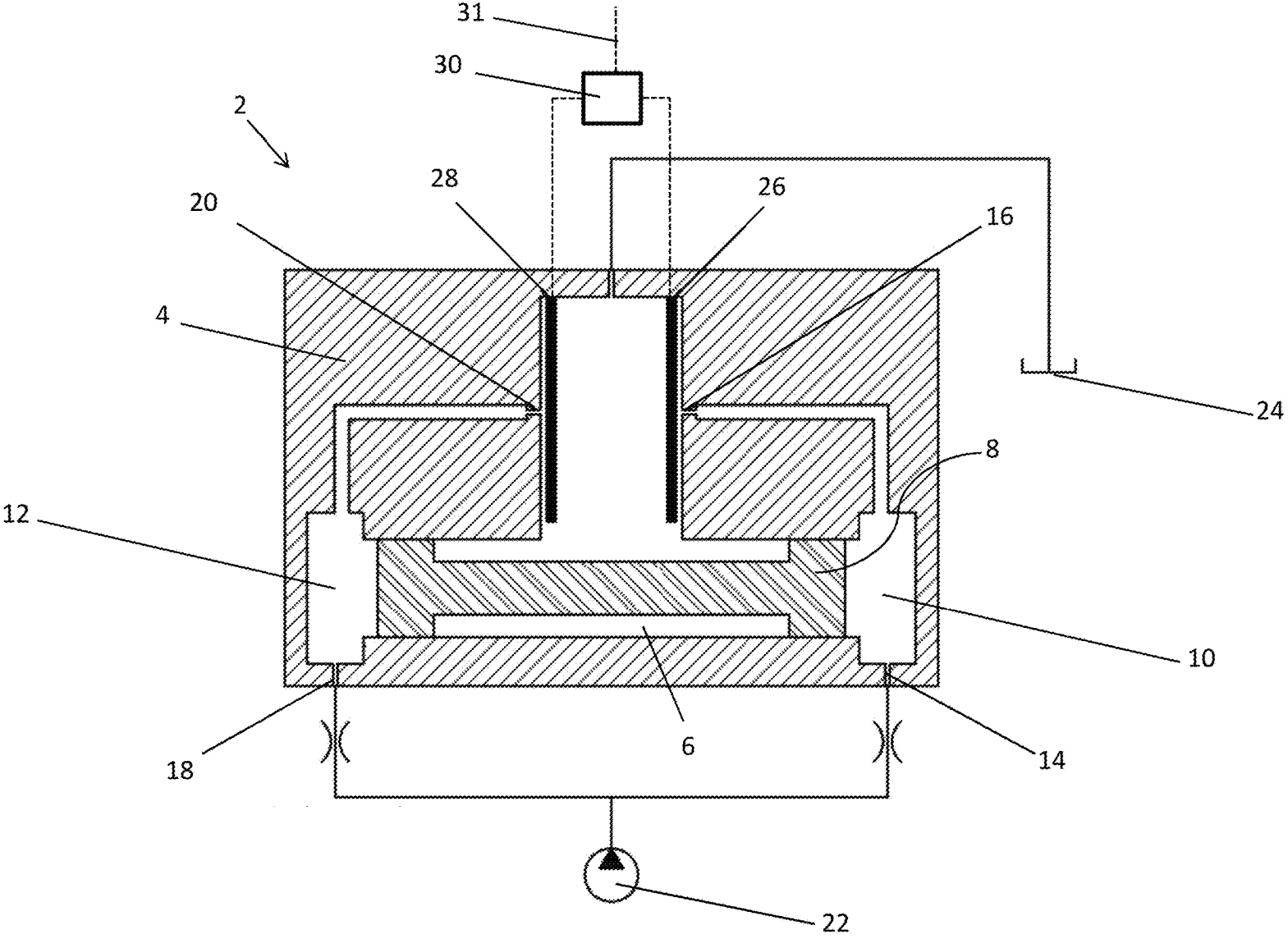
FIG. 1 shows a cross sectional view of a hydraulic stage according to an example of the present disclosure.

FIG. 1 shows a hydraulic stage 2 according to an example of the present disclosure. More particularly, the hydraulic stage shown here is an electrohydraulic servo valve. The stage 2 comprises a housing 4 defining an elongate cavity 6. A spool 8 is disposed within the cavity 6 and defines and seals a first chamber 10 and a second chamber 12. For simplicity, the details of the construction of the spool 8 have been omitted, but it will be appreciated that the spool 8 would typically be operatively connected to another element to control movement thereof. For example, spool 8 might in some examples have other annular chambers formed thereon which make or break fluid connections with other fluid passages depending on the axial position of the spool 8.

The spool 8 is able to slide freely within the cavity. When the spool 8 moves to the right it reduces the volume of the first chamber 10 and increases the volume of the second chamber 12. Correspondingly, when the spool 8 moves to the left it increases the volume of the first chamber 10 and decreases the volume of the second chamber 12.

The first chamber 10 comprises a first inlet 14 and a first outlet 16. Similarly, the second chamber comprises a second inlet 18 and a second outlet 20. The first and second inlets 14, 18 are both connected to a fluid reservoir 22, from which fluid is supplied at a fixed pressure. Alternatively, first and second inlets 14, 18 may be supplied by a pump or a pressurized line.

The first and second outlets 16, 20 are connected to a fluid drain 24, to which fluid can drain from the first and second chambers 10, 12 at a rate limited only by the size of the respective outlets 16, 20.

A first bidirectional bi-morphic piezoelectric element 26 is positioned to partially obstruct the first outlet 16 when in a neutral state (i.e. with no potential difference applied thereto). A second bidirectional bi-morphic piezoelectric element 28 is positioned to partially obstruct the second outlet 20 when in a neutral state. The first and second bi-morphic piezoelectric elements 26, 28 are connected to a control unit 30 which is operable to apply a potential difference to neither, either or both elements 26, 28. The control unit 30 comprises an input 31 to which control signals may be sent to operate the hydraulic stage (e.g. from aircraft flight controls).

Figure 4C:
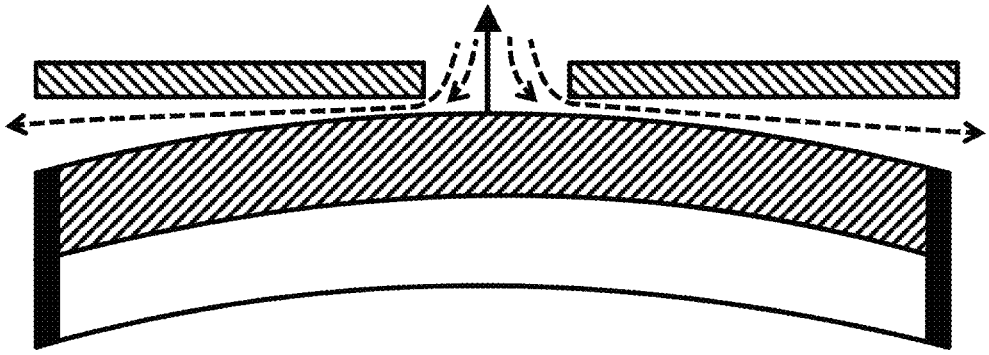
FIGS. 4A-4C illustrate the behaviour of a piezoelectric bimorph.
Figure 4B:
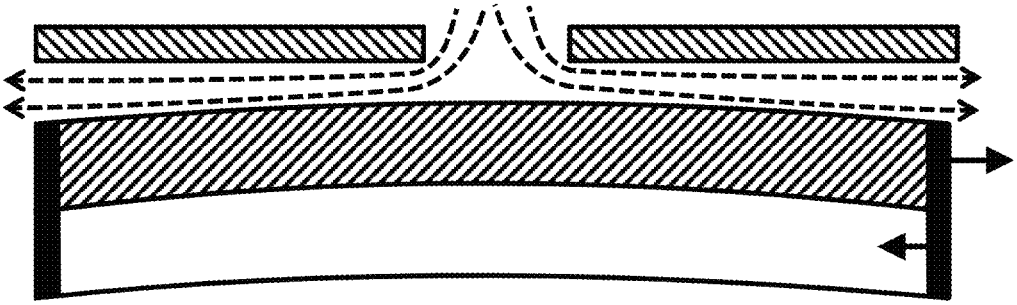
Figure 4A:
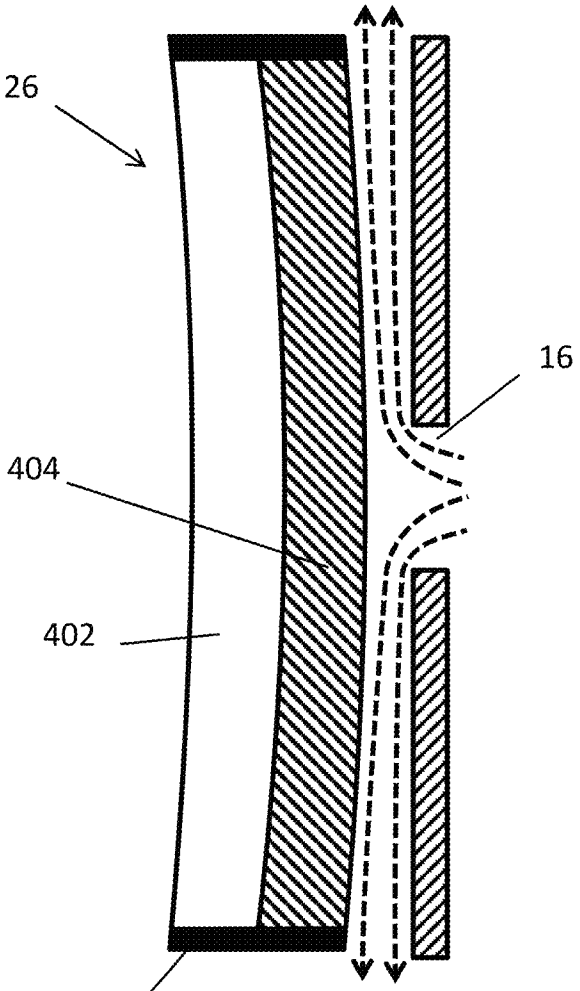

A detailed cross sectional view of the first bi-morphic element 26 in the neutral state is shown in FIG. 4A (and it will be appreciated that the second bimorphic element 28 has the same construction in mirror-image). The bi-morphic element 26, 28 comprises a first piezoelectric layer 402 and a second piezoelectric layer 404 which are attached at their respective ends 406. As mentioned above, the piezoelectric element 26 is positioned to partially obstruct the first outlet 16 (fluid flow is illustrated in FIG. 4A using dashed arrows).

The operation of the hydraulic stage 2 will now be described with reference to FIGS. 2-3.

Figure 2:
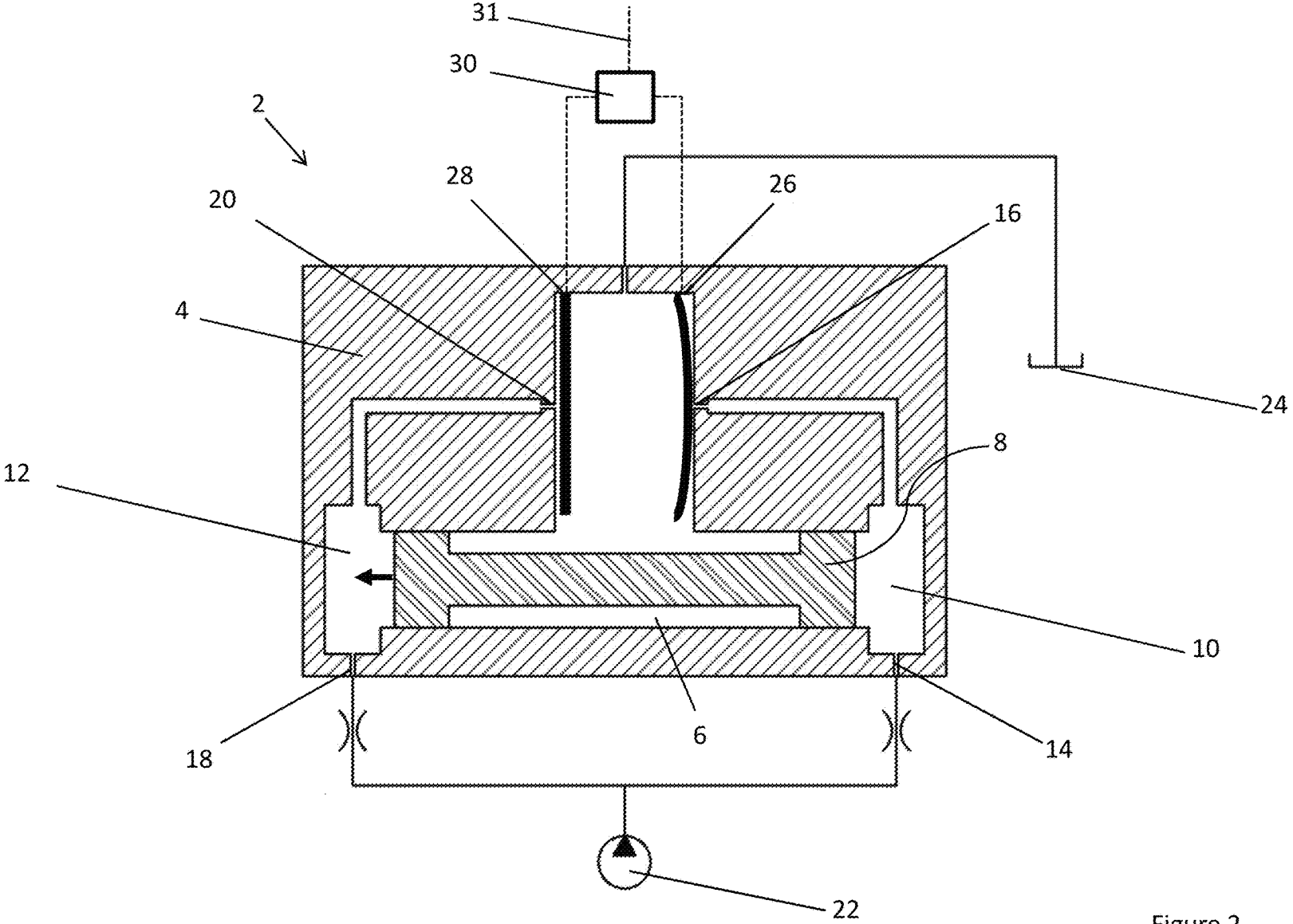
FIGS. 2 and 3 illustrate the operation of the hydraulic stage shown in FIG. 1.

FIG. 2 shows a first state of operation of the hydraulic stage 2 in which a positive potential difference is applied by the control unit 30 to the first piezoelectric element 26. FIG. 4B shows the piezoelectric element in the same configuration as in FIG. 4A but with arrows showing the contraction of first layer 402 and the expansion of second layer 404 caused by the electric potential difference applied thereto. FIG. 4C shows the result of the deformation. As seen in FIGS. 4B and 4C, the potential difference causes the first piezoelectric layer 402 to contract and the second piezoelectric layer 404 to expand. This causes the piezoelectric element 26 (which is fixed at its two opposite ends to the housing 4) to bend towards the first outlet 16. This further obstructs the first outlet 16, reducing its effective size and thus the rate at which fluid can flow therethrough.

The reduced outflow rate from the first chamber 10, coupled with the constant inflow pressure from the first inlet 14, results in the pressure within the first chamber 10 increasing. Contrastingly, the pressure in the second chamber 12 is unaffected and remains constant. As a result of the pressure differential between the first and second chambers 10, 12, the spool 8 experiences a net force to the left, and begins to accelerate in that direction (towards the second chamber 12).

Figure 3:
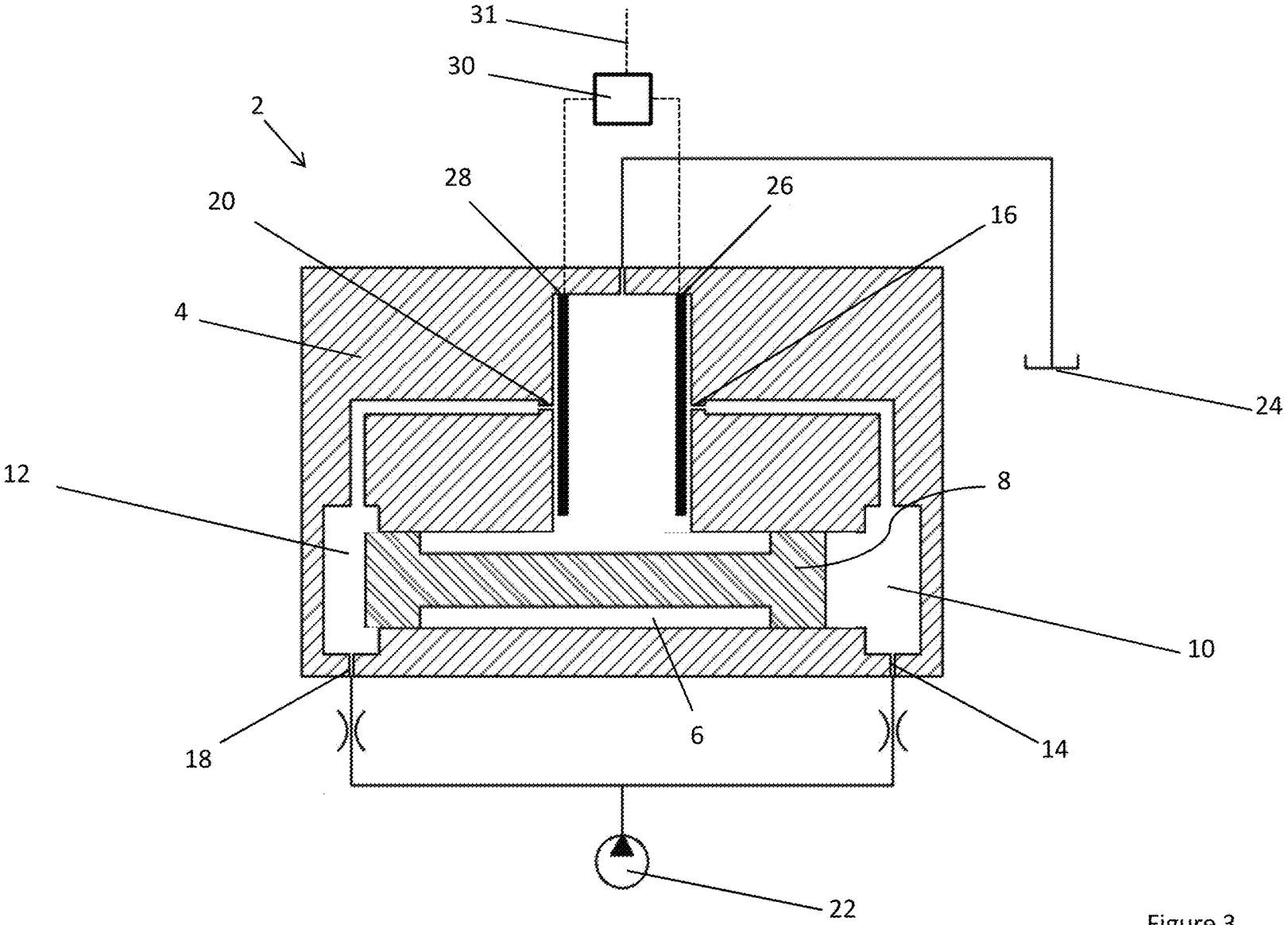

As shown in FIG. 3, once the spool 8 has moved to the required position, the control unit stops applying a potential difference to the first piezoelectric element 26. The first piezoelectric element 26 can now return to its neutral shape and the effective size of the first outlet 16 can return to its initial state. As the outflow from the first chamber 10 is then no longer restricted compared to the outflow from the second chamber 12, the pressures within the first and second chambers 10, 12 equalise and there is no longer a net force on the spool 8. Now due to the absence of a differential pressure between the two chambers the spool 8 stops moving and remains in the required position indefinitely.

In other words, to operate the hydraulic stage 2, a potential difference is applied to the piezoelectric element 26. This induces a deformation of the element 26 and consequently a variation of the effective size of the first outlet 16. This causes a change of flow rate through the first outlet 16 causing a pressure differential to arise between the first and second chambers 10, 12. This displaces the spool 8.

As mentioned above, both the first and second bi-morphic piezoelectric elements 26, 28 are bidirectional and are connected to the control unit 30 such that it can apply a potential difference in any direction to neither, either or both elements 26, 28. As explained below, this adds redundancy to the hydraulic stage, in that desired movement of the spool 8 can be achieved even if one of the piezoelectric elements 26, 28 were to fail and become inoperative.

In the operation described above, the control unit 30 applies a positive potential difference to only the first piezoelectric element 26, in order to move the spool 8 towards the second chamber 12. However, this result may also be achieved by applying a negative potential difference to the second piezoelectric element 28. Because the second piezoelectric elements 28 is bidirectional, this causes the second piezoelectric element 28 to bend away from the second outlet 20. This reduces the obstruction of the second outlet 20, increasing its effective size and thus the rate at which fluid can flow therethrough.

The pressure within the second chamber 12 thus decreases, while the pressure in the first chamber 10 is unaffected and remains constant. As before, the spool 8 experiences a net force to the left, and begins to accelerate in that direction (towards the second chamber 12).

In addition, it is possible to deform both the first and second piezoelectric elements 26, 28 simultaneously (e.g. by applying a positive potential difference to one, and a negative potential difference to the other), to generate an increased pressure differential between the first and second chambers 10, 12. This increases the net force on the spool 8 which can speed up its movement and/or increase the size or mass of spool 8 which may be used.

Figure 5:
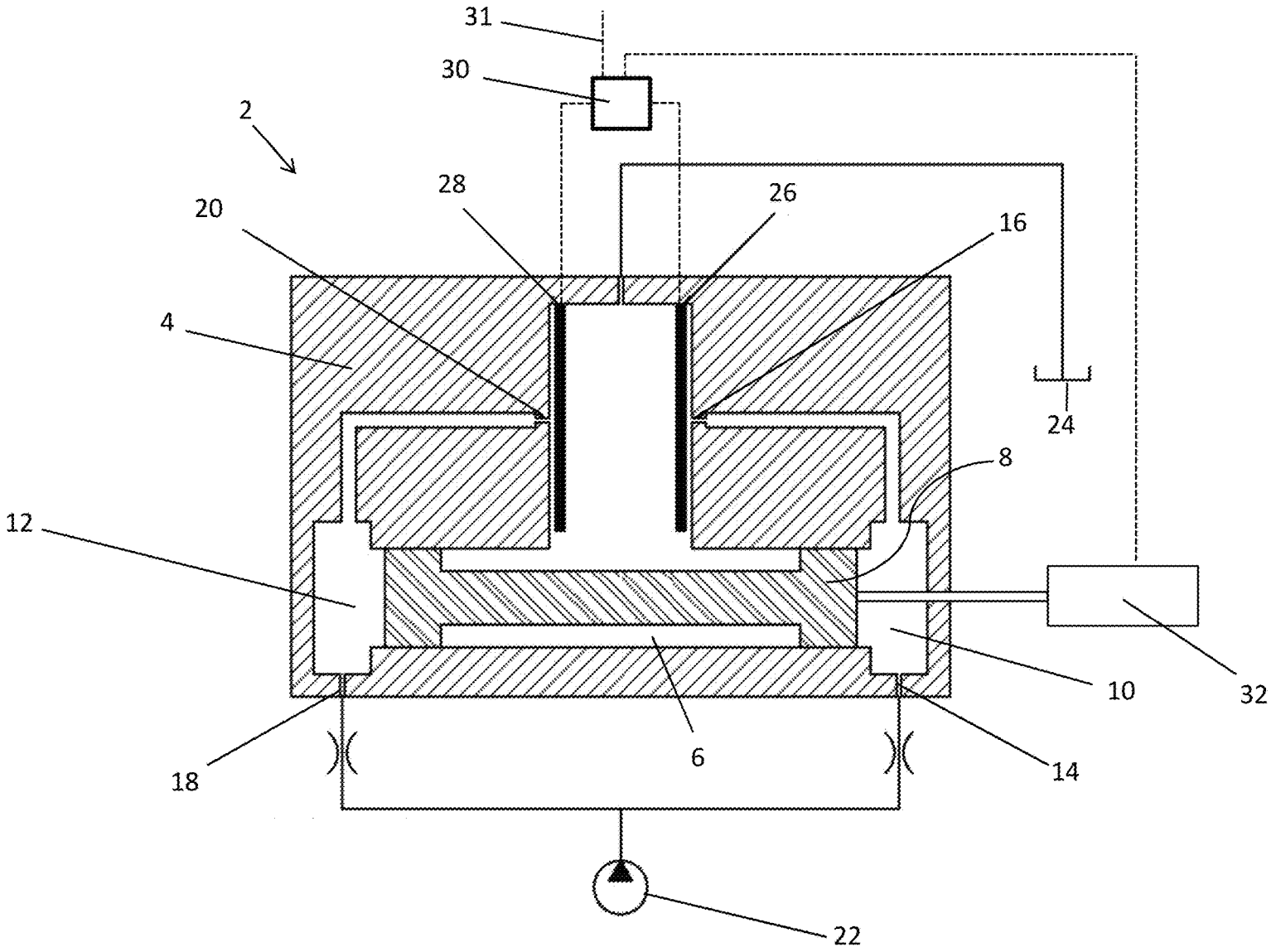
FIG. 5 shows a cross sectional view of a hydraulic stage with electronic position feedback.

As shown in FIG. 5, the hydraulic stage 2 may comprise a position feedback system comprising an electronic position sensor 32. The electronic position sensor 32 is coupled to the spool 8 and is connected to the control unit 30. The electronic position sensor 32 is arranged to output a signal indicative of the position of the spool 8. This signal provides the control unit 30 with feedback on the current position of the spool 8. This enables the control unit 30 to control the piezoelectric elements 26, 28 so as to move the spool 8 into a desired positioned with high accuracy. It also enables the control unit 30 to smooth the motion of the spool 8, by dynamically adjusting the force applied to the spool 8 through continuous adjustment of the potential difference applied to the piezoelectric elements 26, 28 based on the current and desired positions of the spool 8 (e.g. to reduce steadily the force on the spool 8 as it approaches a desired position).

Figure 6:
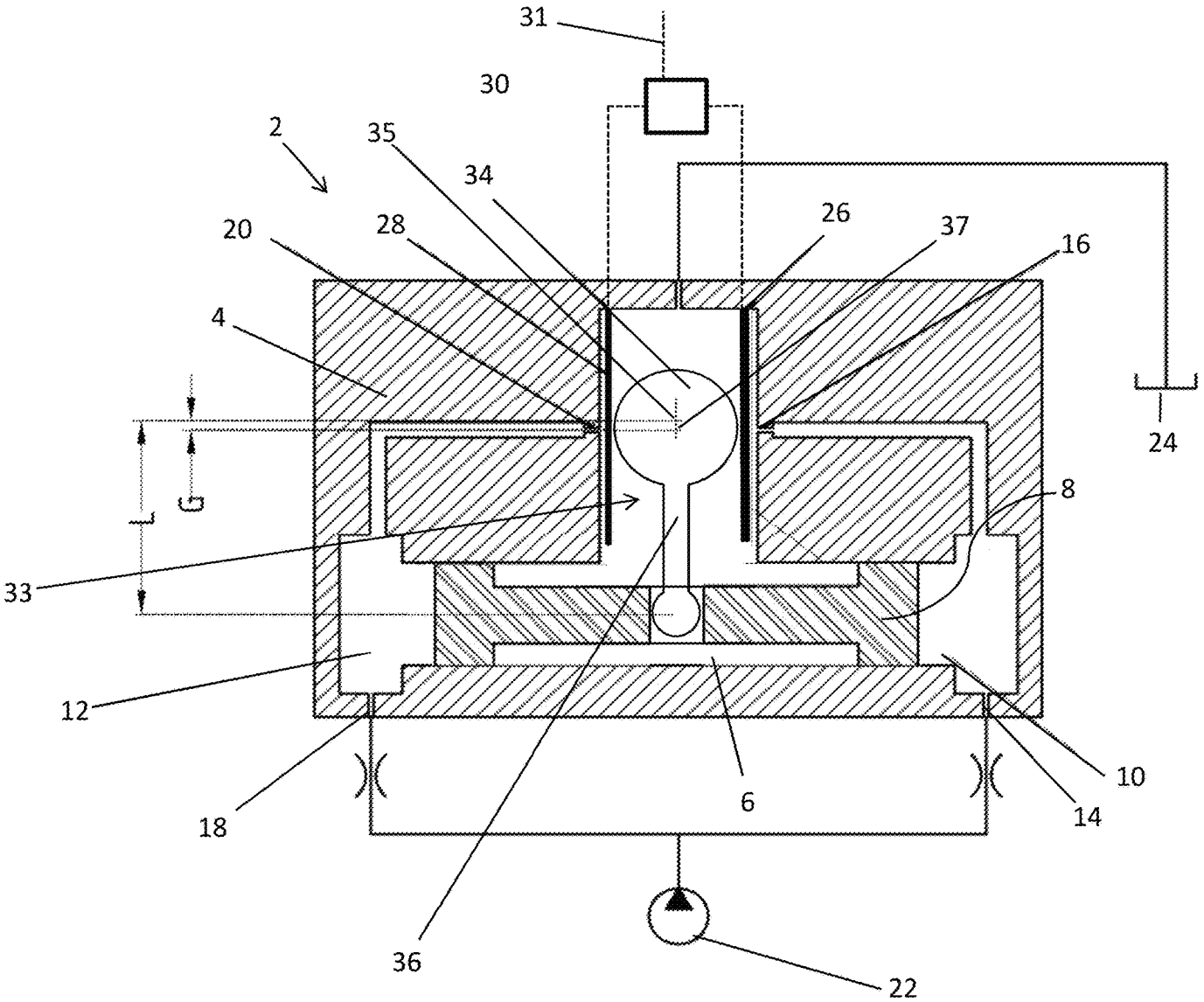
FIGS. 6 and 7 illustrate the operation of a hydraulic stage with mechanical position feedback.

FIG. 6 shows an example of the hydraulic stage 2 comprising a mechanical position feedback system. The mechanical position feedback system comprises a lever 33 comprising a cylinder 34 (although it will be appreciated that a sphere or other shape could be used) with an off-axis pivot 35, located a distance G above the centre 37 of the cylinder 34. The centre 37 of the cylinder 34 is located exactly between the first and second outlets 16, 20 (with the off-axis pivot 35 located the distance G above).

The lever 33 further comprises an arm 36 which extends from the cylinder 34 and is coupled to the spool 8, such that movement of the spool 8 within the cavity causes the cylinder 34 to rotate about the off-axis pivot 35. The lever 33 has a length L.

Because the pivot 35 is off-axis, rotation of the cylinder 34 causes the cylinder 34 to move towards either the first or second piezoelectric elements 26, 28. Thus, when the spool 8 moves towards the second chamber 12, for example, the cylinder 34 rotates clockwise about the pivot 35 and moves towards the second piezoelectric element 28.

The cylinder 34 is sized such that even a small rotation causes it to contact and apply a force to the piezoelectric element 26, 28 towards which it rotates. The force applied causes the piezoelectric element 26, 28 to deform towards the corresponding outlet 16, 20, restricting outflow therethrough and increasing the pressure in the corresponding chamber 10, 12.

Figure 7:
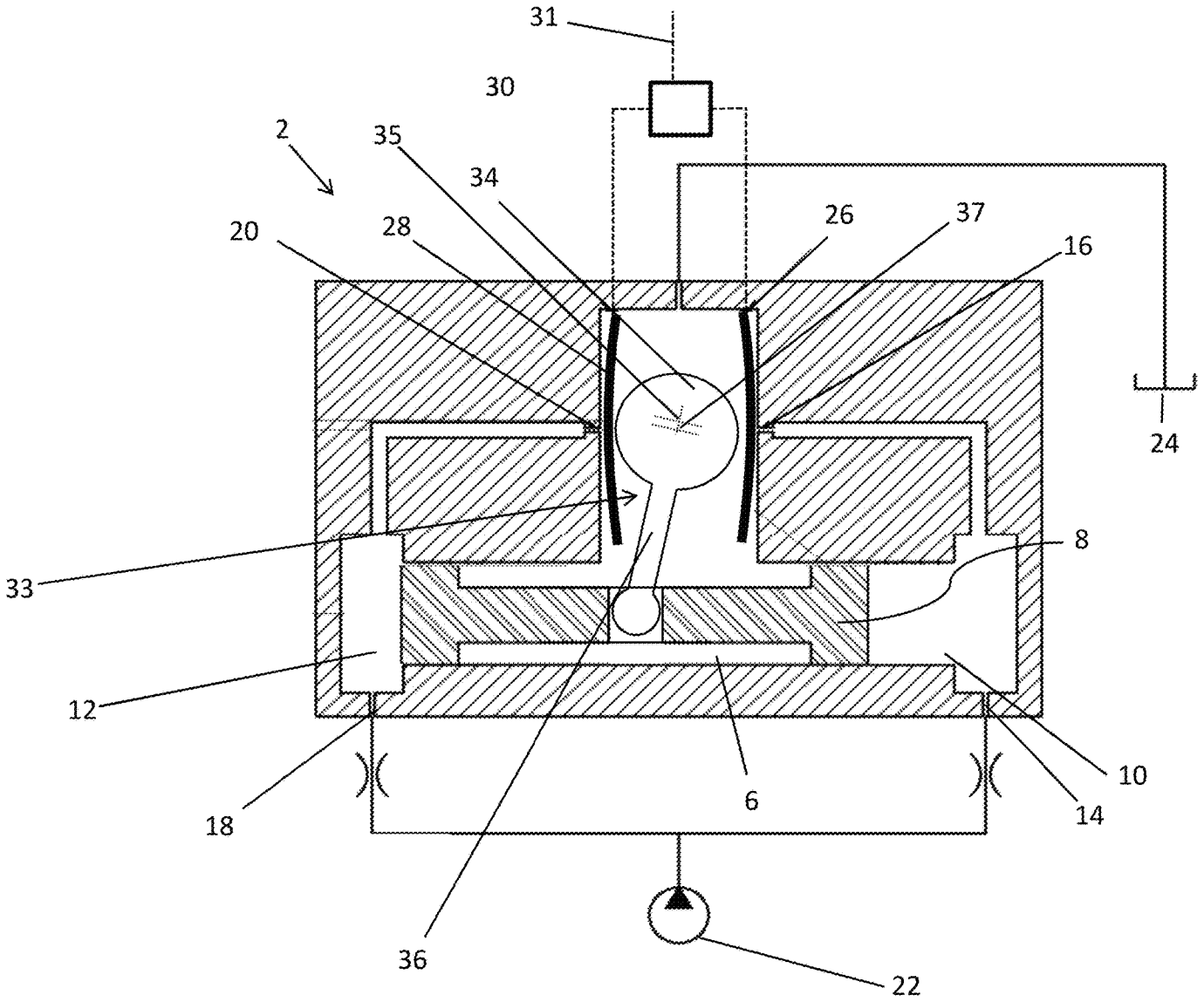

The mechanical position feedback system thus provides negative feedback to any movement of the spool 8. For example, as shown in FIG. 7, when the spool 8 moves towards the second chamber 12 due to a potential difference being applied to the first piezoelectric element 26 (and pressure increasing in the corresponding first chamber 10), the resultant rotation of the cylinder 34 deforms the second piezoelectric element 28, resulting in an increase in pressure in the second chamber 12. When the spool 8 has moved a critical distance towards the second chamber 12 the cylinder 34 has rotated to a point at which the increased pressure in the first chamber 10 (caused by piezoelectric deformation) is balanced by the increased pressure in the second chamber 12 (caused by mechanical deformation) and an equilibrium is reached, preventing further movement of the spool 8. If the potential difference then ceases to be applied to the first piezoelectric element 26, the piezoelectric element 26 returns to its neutral state and the pressure in the first chamber 10 returns to its neutral level. However, the mechanical deformation to the second piezoelectric element 28 remains, and the pressure in the second chamber 12 is thus greater than that in the first (now unrestricted) chamber 10. This pressure differential causes the spool 8 to move back towards a neutral position.

It is possible, by exploiting the property of piezoelectric materials to generate voltage proportional to their deformation when subjected to an external force, to estimate the position of the spool 8 by measuring the potential difference generated by the mechanical deformation to the second piezoelectric element 28. This may be used along with the lever ratio L/G to calculate the position of the spool 8.

When mechanical feedback is implemented as described herein, it may be preferable to use only mono-directional piezoelectric elements 26, 28.

What is claimed is:

1. A hydraulic stage comprising:

a hydraulic element located between and sealing a first and second chamber, wherein the first chamber comprises at least one aperture through which fluid is arranged to flow into or out of the first chamber;

at least one piezoelectric element which is positioned adjacent to the at least one aperture and is arranged to deform in response to an applied potential difference such that it blocks or obstructs the at least one aperture to a varying degree according to the level of deformation, so as to control fluid flow into or out of the first chamber; and a mechanical position feedback system including a feedback member arranged to mechanically deform the at least one piezoelectric element;

wherein the hydraulic stage is configured to measure a potential difference generated by the at least one piezoelectric element and to use the measured potential difference to estimate a position of the hydraulic element.

2. The hydraulic stage as claimed in claim 1 wherein the at least one aperture comprises an inlet aperture through which fluid may be introduced to the first chamber, and an outlet aperture through which fluid may exit the first chamber.

3. The hydraulic stage as claimed in claim 2 wherein the piezoelectric element is positioned adjacent to the outlet aperture and is arranged to control fluid flowing therethrough.

4. The hydraulic stage as claimed in claim 1, wherein the piezoelectric element is arranged to restrict fluid flow into or out of the first chamber when in a neutral position.

5. The hydraulic stage as claimed in claim 1, wherein the piezoelectric element comprises a piezoelectric bimorph.

6. The hydraulic stage as claimed in claim 5 wherein at least one end of the bimorph is fixed in place.

7. The hydraulic stage as claimed in claim 1, further comprising a second piezoelectric element, arranged to control fluid flow into or out of the second chamber.

8. The hydraulic stage as claimed in claim 7 wherein the first piezoelectric element is arranged to control fluid flow out of the first chamber and the second piezoelectric element is arranged to control fluid flow out of the second chamber.

9. The hydraulic stage as claimed in claim 1, claim wherein the hydraulic element comprises a piston or a spool.

10. The hydraulic stage as claimed in claim 1, wherein the hydraulic element comprises a component of a secondary hydraulic stage.

11. The hydraulic stage as claimed in claim 1, further comprising an electronic position feedback system comprising an electronic position sensor coupled to the hydraulic element.

12. The hydraulic stage as claimed in claim 1, wherein the mechanical feedback system is configured to provide negative feedback.

13. A method of operating a hydraulic stage, the hydraulic stage including a hydraulic element located between and sealing a first and second chamber, wherein the first chamber comprises at least one aperture through which fluid is arranged to flow into or out of the first chamber, at least one piezoelectric element which is positioned adjacent to the at least one aperture, and a mechanical position feedback system including a feedback member arranged to mechanically deform the at least one piezoelectric element, the method comprising:

controlling the fluid flow into or out of the first chamber by applying a potential difference to the at least one piezoelectric element such that it deforms so as to block or obstruct the at least one aperture to a varying degree according to the level of deformation; and measuring a potential difference generated by the at least one piezoelectric element and using the measured potential difference to estimate a position of the hydraulic element.

* * * * *